US005277008A

United States Patent [19]

Saulez

[11] Patent Number: 5,277,008

[45] Date of Patent: Jan. 11, 1994

[54] BUILDING BLOCKS

[75] Inventor: John R. Saulez, Stutterheim, South Africa

[73] Assignee: Alexander R. Andrews, South Africa

[21] Appl. No.: 928,489

[22] Filed: Aug. 13, 1992

[30] Foreign Application Priority Data

Aug. 16, 1991 [ZA] South Africa ..... 91/6510

[51] Int. Cl.[5] ..... E04B 1/10

[52] U.S. Cl. ..... 52/233

[58] Field of Search ..... 52/233, 270, 271, 282, 52/582, 585, 586

[56] References Cited

U.S. PATENT DOCUMENTS

| | | | |
|---|---|---|---|
| 2,130,231 | 9/1938 | Forcdea | 52/233 |
| 2,403,934 | 7/1946 | Lindstrom | 52/233 |
| 3,992,838 | 11/1976 | Vizziello | 52/233 |
| 4,356,676 | 11/1982 | Hauptman | 52/233 X |
| 4,443,990 | 4/1984 | Johnson | 52/233 X |
| 4,488,389 | 12/1984 | Farmont | 52/233 X |
| 4,649,683 | 3/1987 | Dolata | 52/233 |
| 4,742,657 | 5/1988 | Veecu | 52/233 |

FOREIGN PATENT DOCUMENTS

| | | | |
|---|---|---|---|
| 25135 | 2/1991 | Japan | 52/233 |
| 445790 | 2/1968 | Switzerland | 52/586 |

*Primary Examiner*—Peter M. Cuomo
*Assistant Examiner*—Jerry Redman
*Attorney, Agent, or Firm*—Wegner, Cantor, Mueller & Player

[57] ABSTRACT

The invention provides a building block which in its operative position has a front (10) and back (12) surface, a top (14) and bottom (16) surface and two end (18) surfaces and a groove (22) formed in both the top and bottom surfaces. The groove (22) is shaped to receive a complementally shaped key (24) in a friction fit manner when one block is placed on top of another.

10 Claims, 2 Drawing Sheets

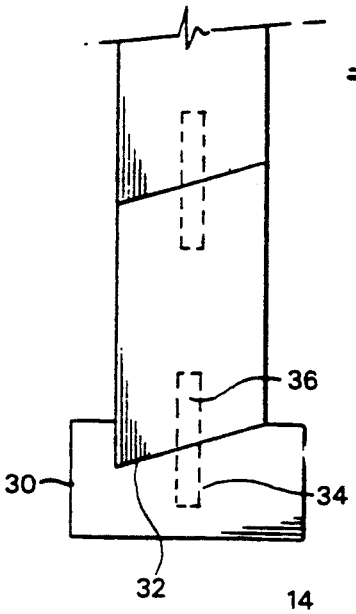
4
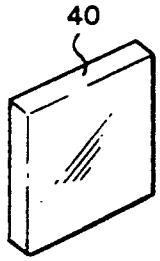
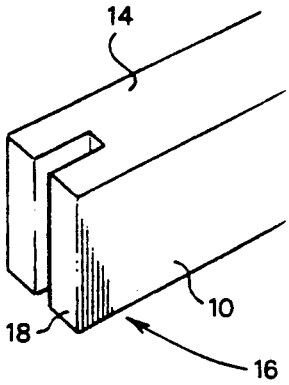
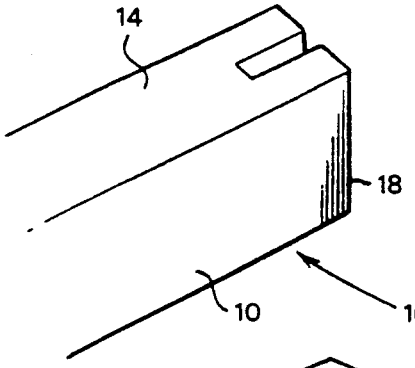
5
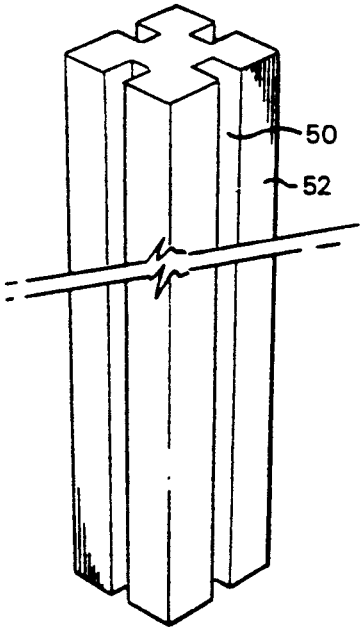
6

BUILDING BLOCKS

BACKGROUND OF THE INVENTION

This invention relates to a building block and wall panels made from such blocks.

There is a continual need for low cost housing. Conventional brick and cement methods of erecting housing is expensive and time consuming and once such housing is erected it cannot be disassembled.

SUMMARY OF THE INVENTION

According to the invention there is provided a building block which in its operative position has a front and a back surface, a top and bottom surface and two end surfaces and a groove formed in both the top and bottom surfaces, the groove being shaped to receive a complementary-shaped key in a friction fit manner when one block is placed on top of another.

Typically the building block is made from wood, a plastics material, a metal material or a cement material. Preferably the building block is made from wood.

Typically the building block has the shape of a parallelopiped.

Preferably the building block has a cross-section such that the top surface and front surface form an obtuse angle with one another.

The building block may further have a groove formed on both end surfaces, the groove running from the top surface to the bottom surface and being shaped to receive a complementary-shaped end key in a friction fit manner when one block is placed at the end of another.

According to another aspect of the invention there is provided a building block as described above in combination with a key complementary-shaped to form a friction fit between the respective top and bottom surface grooves of the blocks when placed one on top of another.

According to a further aspect of the invention there is provided a building block as described above in combination with an end key complementary-shaped to form a friction fit between the respective end surface grooves of adjacent blocks when placed end to end.

The key and end key may be wooden keys.

According to a further aspect of the invention there is provided a wall panel comprising a plurality of blocks as described above stacked side by side and on top of one another and a plurality of keys fixed between the respective top and bottom surface grooves of adjacent blocks.

The panel may further include a plurality of end keys fixed between the respective end surface grooves of adjacent blocks.

According to a further aspect of the invention there is provided a wall structure comprising a wall panel as described above and a plurality of upright posts connected to the panel.

According to another aspect of the invention there is provided a method of making a wall including the steps of:

(a) providing a plurality of building blocks as described above, (b) providing a plurality of keys as described above, (c) locating the keys into the top surface grooves of a layer of the wooden building blocks, (d) locating another layer of building blocks above the previous layer so that the lower surface grooves locate on the keys already inserted into the top surface grooves of the previous layer so as to join the layers, and (e) repeating steps (c) and (d) until the wall is formed.

The method may further include the step of locating side keys into the respective end surface grooves of blocks adjacent one another.

DESCRIPTION OF THE DRAWINGS

The invention will now be described in more detail, by way of example only, with reference to the accompanying drawings in which:

FIG. 4 shows a building block according to the invention connected to a foundation plate;

FIG. 5 shows an exploded view of two blocks and an end key according to the invention;

FIG. 6 shows an upright post used in the construction of a wall panel according to the invention.

DESCRIPTION OF EMBODIMENTS

Figure 1:
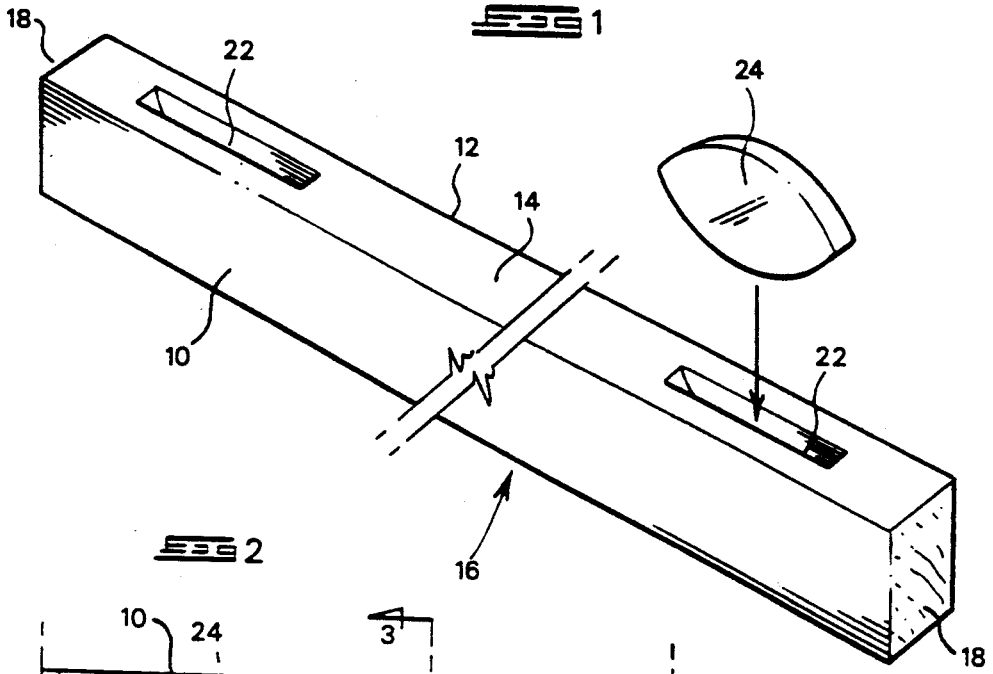
FIG. 1 shows a building block and a key according to the invention.

FIG. 1 shows a building block according to the invention which in its operative position has a front surface 10, a back surface 12, a top surface 14, a bottom surface 16, and two end surfaces 18. In this case the block is made from wood. The block has two grooves 22 formed in the top surface which are illustrated and two identical grooves formed on the bottom surface 16 which are not illustrated. There is shown a wooden key 24 which fits into the groove 22. The key 24 and the groove 22 are sized so that when the key 24 is placed in the groove 22 a friction fit is formed.

Figure 2:
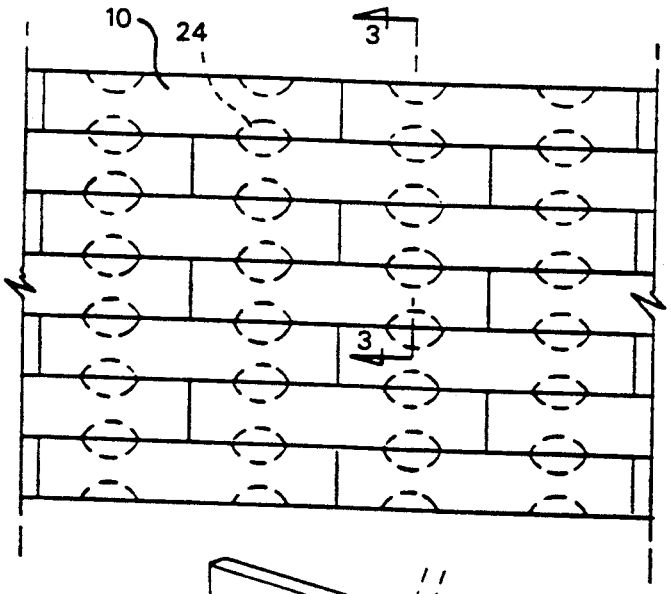
FIG. 2 shows a wall panel according to the invention.

The wooden building blocks are placed one on top of another and stacked side by side to form a wooden wall panel illustrated in FIG. 2. The wooden keys 24 connect adjacent building blocks to one another.

Figure 3:
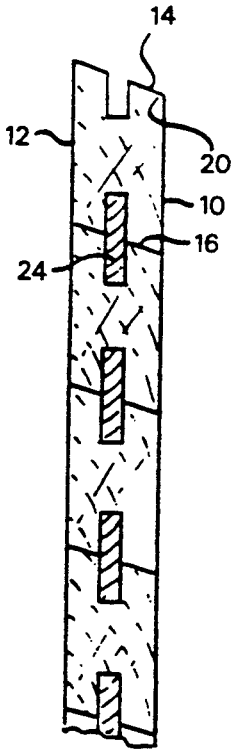
FIG. 3 shows a section of the wall panel illustrated in FIG. 2.

Referring to FIG. 3 there is shown a section of the wooden wall panel illustrated in FIG. 2. The wooden building blocks of this embodiment each are generally parallelpiped in shape. More particularly the blocks shape of a particular parallelpiped wherein a section or end surface forms a parallelogram wherein the top surface 14 and the front surface 10 form an obtuse angle 20 with one another. The reason for this shape of building block is that the line joining one building block to another building block placed on top of it moves upwardly away from the front surface 10 of the building blocks. Thus if rain water were to run along the front surface of the wall panel it would not naturally flow through any gap at the line of joinder. Nevertheless it has been noted that water may move up through such gap by capillary action. In order to minimize this problem a groove extending along either the top surface 14 or bottom surface 16 of each block from one side 18 to the other side 18 may be formed. Alternatively a waterproof coating may be applied to the outside wall panel. There is also shown in FIG. 3 the placement of the wooden keys 24 between adjacent wooden building blocks. It is to be clearly understood that a key of any shape can be used, provided it performs the required function of frictionally holding adjacent blocks together. For example, a single elongate key and a complementary-shaped groove running from one end of a block to the other end of the block could be used as illustrated in FIG. 7.

Figure 7:
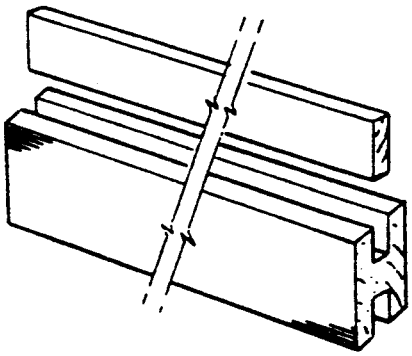
FIG. 7 shows another embodiment of a building block and a key according to the invention.

It is to be noted that in both embodiments of the key and groove illustrated in FIG. 1 and FIG. 7, the key is entirely complementary-shaped with respect to the groove. This means that the entire surface area of a key is in contact with the peripheral walls of the groove of each block. This has two advantages: firstly, a better friction fit between block and key is formed and secondly, there are no cavities between a block and a key when fitted. Such cavities would weaken the structural strength of the block.

FIG. 4 shows a building block according to the invention connected to a foundation plate 30. The foundation plate 30 has a wedge 32 formed on the top surface complementary-shaped with the bottom surface of the building block. The foundation plate further has a groove 34 formed in the groove 32. The groove 34 and the groove 36 formed in the building block are shaped to receive a key in a friction fit manner similar to adjacent building blocks. The foundation plate 30 can be secured to the ground in various ways for example by setting it in cement or by bolting it to an existing floor. The foundation plate can be used for various other purposes such as window frames and window sills or door frames.

FIG. 5 shows two building blocks, and an end key 40 according to the invention. The same numerals have been used to represent the same parts as in FIG. 1. Each end surface 18 has a groove formed thereon, the groove running from the top surface 14 to the bottom surface 16 and being shaped to receive the end key 40 in a friction fit manner when one block is placed at the end of another block. The purpose of the end key is two-fold. Firstly, it holds blocks placed side by side in a more rigid manner than simply being held together by the keys formed on the respective top and bottom surfaces of adjacent blocks. Secondly, it prevents water that enters the line formed between the end surfaces of adjacent blocks from permeating all the way through to the other side of the blocks.

FIG. 6 shows a convenient upright post that can be used in the construction of wall panels according to the invention. The upright post has elongate grooves 50 formed on each side of it. Building blocks such as those described in FIG. 5 will have their end surfaces 18 placed against the side surfaces 52 of the upright post. A single elongate key can then be used to form a friction fit between the upright post and a plurality of building blocks according to the invention to form a wall panel. Alternatively, a plurality of end keys 40 can be used in place of a single elongate key.

A number of advantages are apparent in the invention. Because of the regular shape of the building blocks they can be easily manufactured using ordinary sawing equipment. The grooves formed in the building blocks can equally as easily be formed by means of conventional spindle cutters. The wooden keys are easily stamped from wooden planks using conventional stamping presses. More particularly if the wooden walls of the invention form the walls of a house they can be disassembled and reassembled in order to change the shape of the house. The invention has particular use in low cost housing schemes where an excess of waste timber is available. A further advantage is that the building blocks can be made from hardwoods which are difficult to use conventionally because of the difficulty of using nails or screws. The length of the block indicates that short pieces of timber which are normally wasted can now be used.

I claim:

1. A building block which, in its operative position, comprises:
   - a front and back surface, a top and bottom surface and two end surfaces; and
   - a groove formed in both the top and bottom surfaces, the groove being shaped to receive a complementary-shaped key in a friction fit manner when one block is placed on top of another,
   - wherein said block is generally parallelpiped in shape and has a cross-section such that the top surface and the front surface form an obtuse angle with one another.

2. A building block according to claim 1 which is made from wood.

3. A building block according to claim 1 having a groove formed on both end surfaces, the groove running from the top surface to the bottom surface and being shaped to receive a complementally shaped end key in a friction fit manner when one block is placed at the end of another.

4. A building block according to claim 1 in combination with a key complementally shaped to form a friction fit between the respective top and bottom surface grooves of the blocks when placed one on top of another.

5. A building block according to claim 3 in combination with an end key complementally shaped to form a friction fit between the respective end surface grooves of adjacent blocks when placed end to end.

6. A building block according to claim 1 wherein the key is a wooden key.

7. A wall panel comprising a plurality of blocks according to claim 1 stacked side by side and on top of one another and a plurality of keys fixed between the respective top and bottom surface grooves of adjacent blocks.

8. A wall panel according to claim 7 further including a plurality of end keys fixed between respective end surface grooves formed in adjacent blocks.

9. A wall structure comprising a wall panel and a plurality of upright posts connected to the wall panel, the wall panel comprising a plurality of blocks according to claim 1 stacked side by side and on top of one another and a plurality of keys fixed between the respective top and bottom surface grooves of adjacent blocks.

10. A method of making a wall including the steps of:
   - (a) providing a plurality of building blocks and complementary-shaped keys according to claim 1;
   - (b) locating the keys into the top surface grooves of a layer of the building blocks;
   - (c) locating another layer of building blocks above the previous layer so that the lower surface grooves locate on the keys already inserted into the top surface grooves of the previous layer so as to join the layers; and
   - (d) repeating steps (b) and (c) until the wall is formed.

* * * * *